US005330392A

United States Patent [19]

Bresin et al.

[11] Patent Number: 5,330,392

[45] Date of Patent: Jul. 19, 1994

[54] FINGER GRIP INSERT PROVIDING SIZE COMPLIANCE

[76] Inventors: Mark Bresin, 9900 NW. 6th St., Coral Springs, Fla. 33071; William Thielen, 7902 SW. 8th, North Lauderdale, Fla. 33068

[21] Appl. No.: 72,435

[22] Filed: Jun. 7, 1993

[51] Int. Cl.[5] ..... A63B 37/00

[52] U.S. Cl. ..... 473/130

[58] Field of Search ..... 473/127, 128, 129, 130

[56] References Cited

U.S. PATENT DOCUMENTS

| | | | |
|---|---|---|---|
| 1,080,307 | 12/1913 | Sondheimer | 473/129 |
| 2,210,528 | 8/1940 | Darby | 473/129 |
| 2,842,367 | 7/1958 | Keith | 273/63 A |
| 2,979,334 | 4/1961 | Mitchell | 473/130 |
| 3,963,238 | 6/1976 | Patrignani | 473/130 |
| 4,289,312 | 9/1981 | Heimbigner | 273/63 A |
| 4,763,940 | 8/1988 | Held | 294/25 |
| 4,773,645 | 9/1988 | Todd | 273/63 A |
| 4,778,178 | 10/1988 | Haza | 273/63 A |
| 5,176,378 | 1/1993 | Bernhardt | 273/63 A |

*Primary Examiner*—George J. Marlo
*Attorney, Agent, or Firm*—Dale Dorinski

[57] ABSTRACT

A finger grip insert has a tubular resilient body with an outer wall having at least one recessed section with a concave shape. The center of the tube is shaped to accommodate a human finger. The deformable insert fits into a bowling ball finger hole, and has two sections. The first section extends from the outer surface of the bowling ball to the bowler's fingertip when the finger is placed into the insert. The outer wall of the first section has one or more recesses formed that extend only partially through the tubular body to permit the insert to deform within the finger hole in the area of the recess, responsive to pressure from the bowler's finger. The second section extends from the bowler's fingertip to the end of the insert, and provides a surface to attach the insert to the bowling ball finger hole.

20 Claims, 3 Drawing Sheets

FINGER GRIP INSERT PROVIDING SIZE COMPLIANCE

TECHNICAL FIELD

This invention generally relates to a finger grip insert, and more particularly, to an insert for a bowling ball finger hole.

BACKGROUND

The sport of bowling is well known, and played by millions. We are concerned here with the bowling ball, which is large and heavy, and of a diameter that makes it virtually impossible to be safely handled with one hand. In order to propel the ball with one hand, holes are drilled into the ball for insertion of the fingers of the bowler's preferred hand. Most often, three such holes, for a thumb and two fingers, are precisely drilled, defining a triangle on the surface of the ball. Using them, the bowler can propel the ball down the alley in a fluid, one-handed motion toward the bowling pins.

The diameters of the drilled holes are chosen to accommodate the individual user. Since each person has differing finger sizes, bowling balls are typically custom fit for optimum efficacy. This presents a less than ideal solution because the owner of the ball will find that his fingers will not always fit the holes as well as he might like, due to changes in finger size from swelling, injury, or weight gain or loss. Moreover, other people will not be able to use that ball as the holes will be the wrong size for their fingers. Finger holes are typically drilled in increments of 1/32 inch, and since human fingers are not formed in 1/32 inch increments, this presents an undesirable compromise.

The situation is most acute for the novice bowler who, typically, does not own a ball, but 'borrows' one from the bowling alley. The novice must search through of the many 'loaners' available at the establishment to hopefully find one that gives the best fit. Compromise in this situation is unavoidable.

Further, since the bowling ball is by necessity made from a hard material, frequent bowling often results in sore fingers, chafing, or even blisters and calluses. Particularly strong bowlers, known in the vernacular as 'crankers', commonly release the ball with a severe rotation of the wrist and fingers to impart spin to the ball and create a curved path for the ball to impact the pins. This type of ball release requires the user's fingers to withstand a significant amount of side pressure, creating fatigue and discomfort.

Prior art solution have attempted to solve these problems by providing many types of finger hole inserts for bowling balls. Typical of such inserts are those disclosed in U.S. Pat. Nos. 4,968,033; 4,289,312; 5,176,378; 4,778,178; 2,842,367; 4,773,645; and 4,561,654. One solution is posed in U.S. Pat. No. 4,289,312 which discloses a finger hole insert made from resilient vinyl. During the delivery of the ball, the insert is said to compress under the bowler's finger pressure. However, those skilled in the art will appreciate that elastomers such as vinyls and rubbers do not compress, but merely displace, and inserts of this type have minimal, if any compliance to accommodate varying finger sizes. The variety of ideas found in these patents attest to the need for a solution to the problem. Most bowlers today continue to suffer from poor finger fit, and as a consequence, compromise the optimum situation.

Clearly, the problems illustrated above would find a solution in a bowling ball having holes whose diameters could be easily adjusted, and whose holes could provide compliance. The present invention provides such a solution.

SUMMARY OF THE INVENTION

Briefly, according to the invention, there is provided a finger grip insert comprising a tubular resilient body. An outer wall of the insert has at least one recessed section having a concave shape. The inner wall is shaped to accommodate a human finger.

In another embodiment of the invention, a deformable insert is provided for a finger hole of a bowling ball, and receives a bowler's finger. The insert is a resilient tubular body having two sections. The first section extends from the outer surface of the bowling ball to the bowler's fingertip when the finger is placed into the insert. The outer wall of the first section has one or more recesses formed therein, that extend only partially through the tubular body so as to permit the insert to deform within the finger hole in the area of the recess, responsive to pressure from the bowler's finger. The second section extends from the bowler's fingertip, and provides a surface to attach the insert to the bowling ball finger hole.

In still another embodiment, a bowling ball has at least two finger holes, and an insert in at least one of the finger holes. The insert is a resilient tubular member with a hollow core adapted to receive a bowler's finger. At least one recess is formed in the outer wall of the insert so that the insert is able to deform in response to pressure exerted on the resilient tubular member by the bowler's finger.

DETAILED DESCRIPTION OF THE PREFERRED EMBODIMENT

Figure 1:
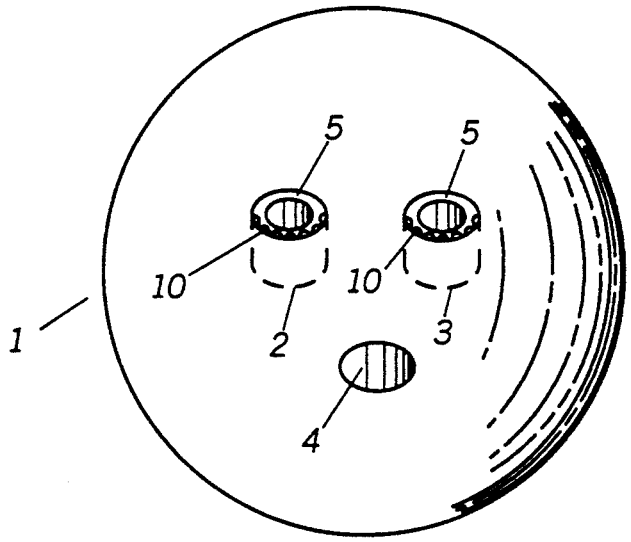
FIG. 1 is a plan view of a bowling ball according to the present invention.

While the specification concludes with claims defining the features of the invention that are regarded as novel, it is believed that the invention will be better understood from a consideration of the following description in conjunction with the drawing figures, in which like reference numerals are carried forward.

Figure 2:
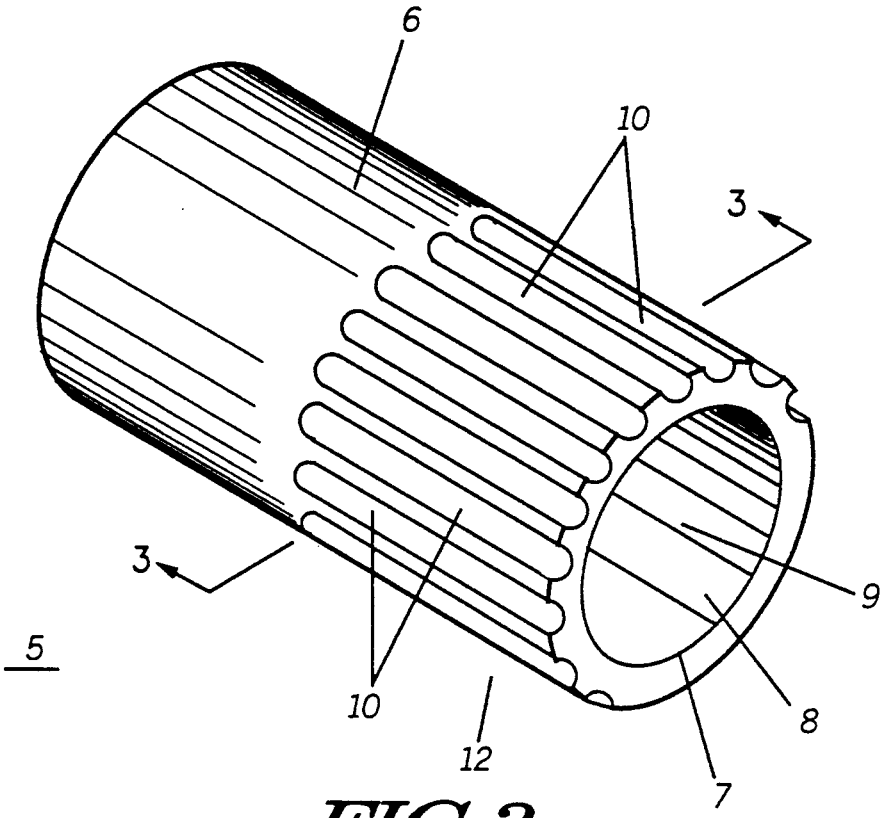
FIG. 2 is a perspective view of an insert in accordance with a preferred embodiment of the invention.

Referring now to FIG. 1, a bowling ball 1 is shown for purposes of illustration to have three finger holes (2, 3, and 4) drilled partway into the interior. Those skilled in the art of bowling will appreciate that some balls have fewer than three holes, for example, a particular bowler may elect to only use two holes. Holes 2 and 3 are typically used for the fingers, and hole 4 is generally a thumb hole. for present purposes, the thumb is to be construed as a finger, that is, the insert of the instant invention is equally adaptable for use with fingers or thumb. A resilient, elastomeric insert 5 resides in the finger holes 2–4 such that the outer edge of the insert is substantially flush with the surface of the ball. Again, although the figure depicts a bowling ball with inserts in each of the finger holes, one, two or three inserts may be used, in response to the needs and wishes of the individual bowler, and still fall within the spirit and scope of the invention. Referring now to FIG. 2, an isometric view of the insert reveals the novel structure of the instant invention. In this preferred embodiment of the invention, the insert 5 is formed of a resilient, elastomeric material such as silicone rubber, thermoplastic elastomer, synthetic rubber, vinyl, urethanes, neoprene, or other similar materials. The resilient material is preferably a solid material, but may also be any number of foam-type materials, typically containing small cavities of a gas. In any event, resilient materials having durometers between Shore A 20 and Shore A 80 may be useful, with a Shore A durometer of about 60 being preferred. In practice, the insert 5 is made by, for example, injection molding the elastomeric material into a mold cavity. Injection molding and other comparable techniques such as potting, casting, RIM molding, etc. are well known, and will be readily understood by those skilled in the art.

Figure 3:
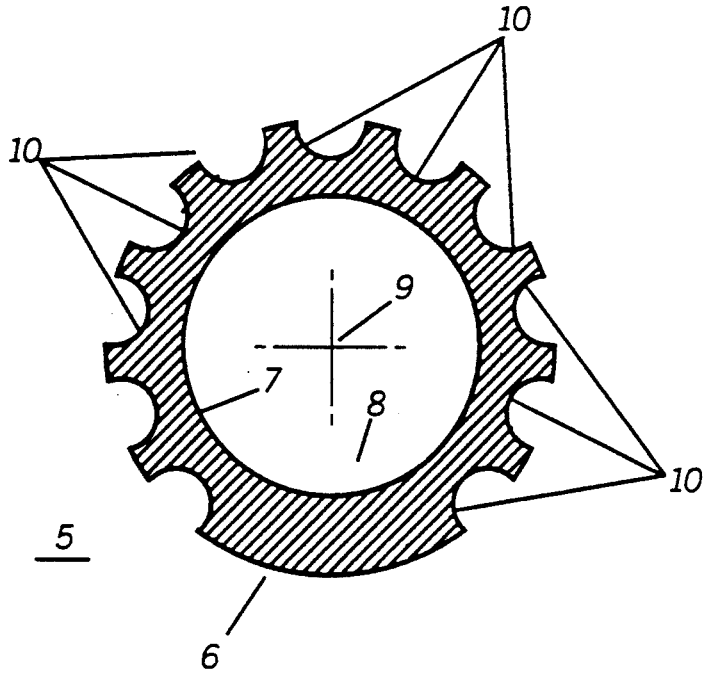
FIG. 3 is a cross-sectional view through section 3—3 of FIG. 2.

The insert 5 is a generally tubular member with an outer wall 6 and an inner wall 7. A tube being generally defined as a hollow, elongated cylinder, the tubular member has an aperture 8 down the middle. The aperture 8 generally extends the full length of the insert, but may be truncated if so desired, leaving a tube with a closed end at the bottom. The aperture 8 is shown to be substantially parallel to and in line with a central axis 9 of the tube, coaxial with the outer wall 6, but may also be off-center or skewed. Generally speaking, the axis of the aperture will be coaxial with the axis of the insert, to aid in manufacturing and to aid in fitting the insert into the ball. A series of recesses 10 are formed in the outer wall and disposed longitudinally around the periphery. FIG. 2 shows the recesses 10 in the shape of flutes extending partially down the length of the tube on the outer wall. These flutes extend in a direction parallel to the central axis 9, longitudinal to the insert 5. They also are disposed radially around the circumference of the insert. FIG. 3 shows details of one arrangement of the recesses 10 disposed radially around the insert 5. Flutes or recesses should cover between about 90 degrees and about 360 degrees of the outer wall, with a range of between 135 to 270 degrees being the optimum. In the preferred embodiment of the invention, the flutes cover about 225 degrees of the outer wall, leaving the remaining 135 degrees of the wall essentially smooth. Various bowlers might need other types or configurations of the flutes or recesses, to provide a custom 'feel' for bowlers of differing skill levels. For example, to create a stiffer insert without changing the type of resilient material, fewer flutes would be used. Some bowlers might want a very 'forgiving' insert, thereby necessitating more flutes, or flutes around a larger portion of the periphery of the insert.

Figure 4:
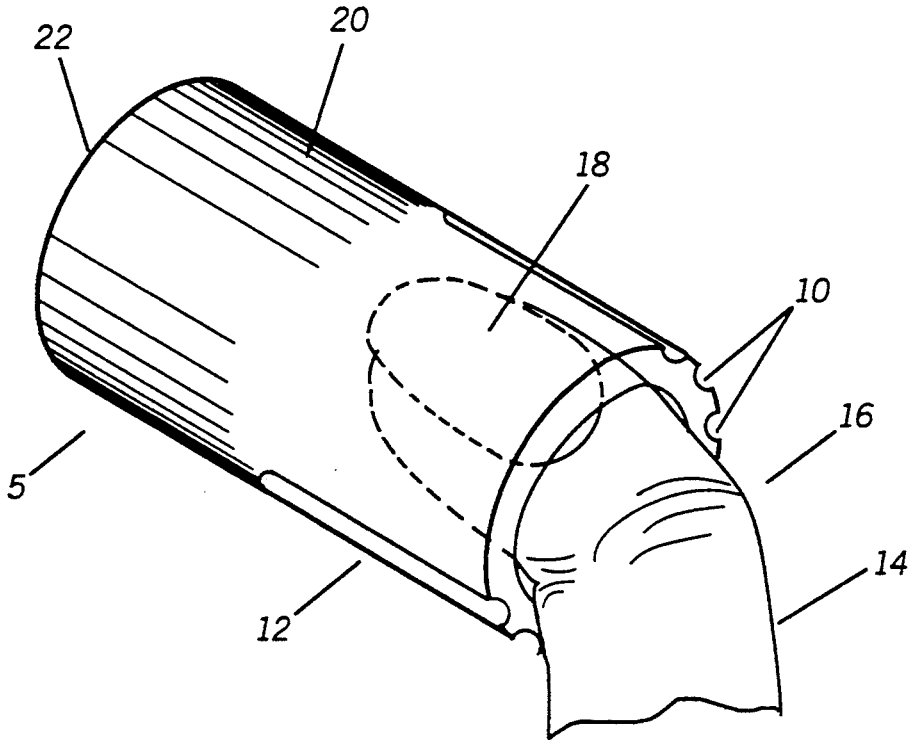
FIG. 4 is a pictorial view of a finger in a finger grip insert in accordance with the present invention.

Note that the recesses 10 only extend over a portion 12 of the insert. Normally, the length of this first portion is a function of the bowler's finger size. It has been found that this length is typically about two times the diameter of the bowler's finger, although this will vary somewhat amongst individuals. A more precise way to define the size of this portion would be in terms of the function served. As shown in FIG. 4, the recesses 10 should be formed in the area 12 of the insert coinciding with that portion receiving the bowler's finger 14. Normally, this would be defined by an area corresponding to that covered from the first knuckle 16 to the distal end 18 of the finger, when the finger is placed in the insert up to the first knuckle. Creating recesses in the insert beyond this point, would still fall within the scope and spirit of the invention. The reader should also note that the end of the insert is substantially flush with the outer surface of the ball when it is placed into the finger hole, so as not to interfere with smooth rolling of the ball down the alley.

Figure 5:
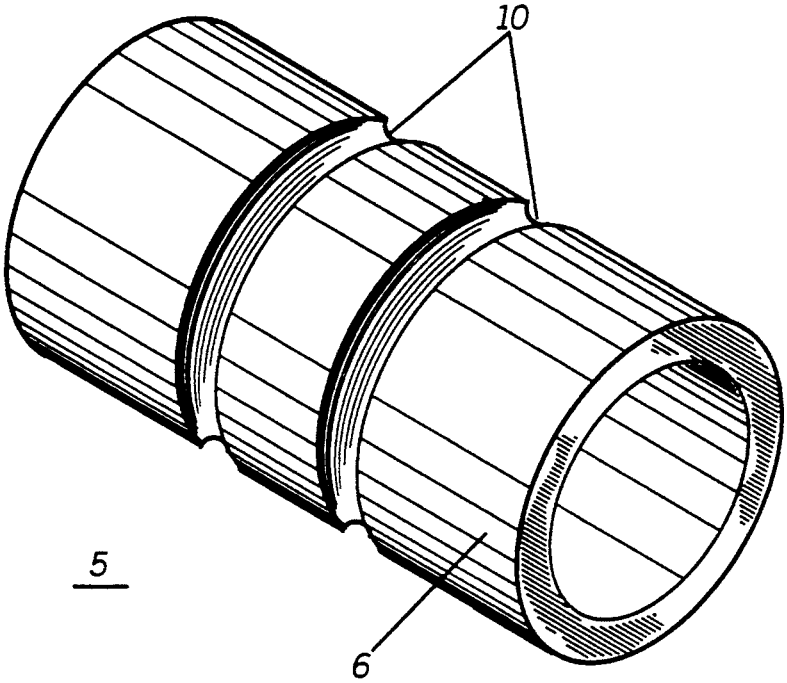
FIG. 5 is a perspective view of an alternate embodiment of the invention.
Figure 6:
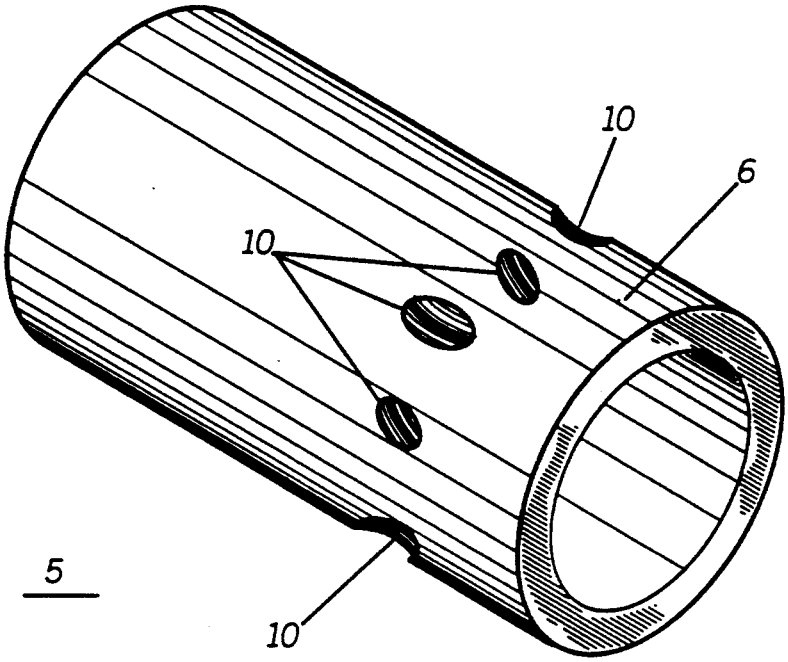
FIG. 6 is a perspective view of an another embodiment of the invention.

Alternate embodiments of the invention employ recesses 10 extending the full length of the outer wall. Still further embodiments, FIG. 5 show the recesses 10 extending circumferentially around the outer wall 6 of the insert. FIG. 6 shows that the recesses 10 may also be a series of discontinuous cavities, of the same size and shape, or of differing size and shape, as dictated by the needs of the bowler. Various other types of recesses will, of course, come to mind, and should be interpreted to be within the spirit and scope of the present invention.

The recesses in the outer wall form a suspension system that provides compliance to the insert. These recesses deform in response to pressure exerted by the bowler's finger against the inner wall of the insert. Since there is an empty space (the recess 10) between the rigid wall of the bowling ball finger hole and the resilient insert, the insert can deform to accommodate various finger shapes and sizes, and in response to finger pressure during delivery of the ball. This improved suspension system gives the bowler an additional "spring" action as the insert is deformed during delivery, and provides greater torque action or rotation of the ball as this energy is expelled during the ball release. Prior art solutions did not provide any compliance, but attempted to rely on the resilient properties of the soft insert. Those skilled in the art will appreciate that elastomers do not compress, but simply deform, and the earlier solutions did not provide any means for deformation, as is provided in the instant invention. The compliance provided by the insert aids in achieving a proper fit because it allows for variations in the "span" dimension of the ball. "Span" is the distance between the finger holes, and is typically fixed in the prior art configurations. The compliance provided by the instant invention also compensates for swelling of a bowler's fingers during the course of a series of games, and also helps to prevent abrasions and blisters on the bowler's fingers.

The insert should be secured in the finger hole in order to keep the insert from popping out of the ball upon delivery. Typically, the insert is attached to the hole by means of an adhesive, for example, an epoxy, urethane, hot melt, cyanoacrylate, 'super glue', etc. A second portion 20 of the insert, that portion extending from the fingertip 18 to the bottom 22 of the insert, does not normally have the recesses that are found in the first portion. This area is useful for attaching the insert to the finger hole, and attachment is maximized by maximizing the surface area. To this end, recesses are generally avoided here, unless they are made to increase the adhesion to the hole, for example, dimples or 'dovetailed' cavities to aid in mechanical bonding. By selecting the proper adhesive, the insert can be replaced when a change in the bowler's delivery style dictates, or when the insert has been worn out or broken. The insert is simply extracted, the remaining adhesive removed, and a new insert of the proper type is glued in. This allows more flexibility and a better custom fit for the ball, affording the bowling retailer (pro shop, etc) greater ease of customer fitting and reduced inventory, while providing an added value to the bowler.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A deformable insert for a bowling ball, adapted to fit into a finger hole of the ball, and to receive a bowler's finger, comprising:

a resilient tubular body having first and second sections;

the first section extending from an outer surface of the bowling ball to a distal tip of the bowler's finger, an outer wall of the first section having one or more recesses formed therein, the recess extending only partially through the tubular body so as to permit the insert to deform within the finger hole in the area of the recess, responsive to pressure from the bowler's finger;

the second section extending from the distal tip of the bowler's finger, an outer wall of the second section providing a surface to permit attaching the insert to the bowling ball finger hole.

2. The insert of claim 1, wherein the one or more recesses comprises a plurality of fluted sections.

3. The insert of claim 1, wherein the one or more recesses cover between about 90 and about 270 degrees of the outer wall.

4. A finger grip insert, comprising:

a tubular resilient body having an outer wall and an inner wall; and the outer wall having at least one recessed section having a concave shape.

5. The finger grip insert of claim 4, wherein the recessed sections are disposed circumferentially on the outer wall.

6. The finger grip inset of claim 4, wherein the recessed sections are fluted and substantially parallel to each other.

7. The finger grip insert of claim 6, wherein the fluted sections cover between about 90 degrees and about 270 degrees of the outer wall.

8. The finger grip insert of claim 4, wherein the inner wall is substantially coaxial with the outer wall.

9. The finger grip insert of claim 4, wherein the inner wall is shaped to conform to a human finger.

10. An insert for a bowling ball finger hole, comprising:

a resilient tubular member adapted to fit into the bowling ball finger hole, having;

a central axis;

an outer cylinder wall;

at least one recess in the outer cylinder wall; and an aperture extending substantially parallel to the central axis, the aperture adapted to receive a bowler's finger; and the at least one recess able to deform in response to pressure exerted on the resilient tubular member by the bowler's finger.

11. The insert of claim 10, wherein the at least one recess comprises a plurality of fluted sections.

12. The insert of claim 11, wherein the fluted sections are substantially parallel to each other.

13. The insert of claim 11, wherein the fluted sections only extend over portions of the outer wall.

14. The insert of claim 11, wherein the length of the fluted section is about twice the diameter of the bowler's finger.

15. An insert for a bowling ball finger hole, comprising:

a tubular resilient body having an outer wall adapted to be inserted into the finger hole, and having an inner wall forming an aperture substantially coaxial to a central axis of the body, the aperture adapted to receive a bowler's finger; and a plurality of concave fluted sections disposed substantially parallel to each other on portions of the outer wall such that a long axis of each fluted section is substantially parallel to the central axis of the body, the fluted sections extending only partially down the outer wall and only partially around the circumference of the wall.

16. The insert of claim 15, wherein the fluted sections comprise between about 90 and about 270 degrees of the outer wall.

17. A bowling ball, comprising;

a spherical ball having at least two finger holes;

an insert in at least one of the finger holes, the insert comprising a resilient tubular member having;

an outer cylinder wall;

a hollow core adapted to receive a bowler's finger; and at least one recess in the outer cylinder wall able to deform in response to pressure exerted on the resilient tubular member by the bowler's finger.

18. The bowling ball of claim 17, wherein the insert is adhesively bonded in the bowling ball finger hole.

19. The bowling ball of claim 17, wherein the inserts provide span compliance between two holes.

20. The bowling ball of claim 17, wherein the inserts provide spring action to aid in imparting rotation to the ball as it is delivered by the bowler.

* * * * *